United States Patent [19]

Groth

[11] 4,022,439

[45] May 10, 1977

[54] FIBROUS CONCRETE BATCH FORMING SYSTEM

[75] Inventor: Steven L. Groth, Armington, Ill.

[73] Assignee: Caterpillar Tractor Co., Peoria, Ill.

[22] Filed: July 11, 1975

[21] Appl. No.: 595,204

[52] U.S. Cl. ..... 259/165; 209/135

[51] Int. Cl.[2] ..... B28C 7/04; B07B 7/00

[58] Field of Search ..... 259/164, 145, 165, 154; 106/99, 90; 209/134–137; 19/155, 205

[56] References Cited

UNITED STATES PATENTS

| | | | |
|---|---|---|---|
| 1,559,146 | 10/1925 | Andrews | 106/99 X |
| 2,222,861 | 11/1940 | Stoner | 209/135 |
| 2,968,069 | 1/1961 | Powell | 19/156.1 |
| 3,300,193 | 1/1967 | Badgett | 259/154 |

*Primary Examiner*—Richard E. Aegerter

*Assistant Examiner*—Richard R. Stearns

*Attorney, Agent, or Firm*—Wegner, Stellman, McCord, Wiles & Wood

[57] ABSTRACT

An improved fibrous concrete batch forming system. The system includes a conveyor for introducing concrete ingredients in solid form into a mixer or the like together with apportioning devices for apportioning large aggregate, cement and sand onto the conveyor. An apportioning device is also provided for apportioning fibrous reinforcing material onto the conveyor. A hopper or the like serves as a source of fibrous reinforcing material. A separator receives fiber from the hopper and separates the same into balls of fiber and substantially individual fibers. Associated with the separator is a device for directing only substantially individual fibers from the separator to the fiber apportioning device.

1 Claim, 2 Drawing Figures

FIBROUS CONCRETE BATCH FORMING SYSTEM

BACKGROUND OF THE INVENTION

This invention relates to fibrous concrete and, more particularly, to an improved fibrous concrete batch forming system.

The desirability of employing fibrous reinforcing material in concrete has been known for a number of years. In many instances, the use of fiber reinforcing material eliminates the need for reinforcing rods in that fiber reinforced concrete can have the strength of rod reinforced concrete and can be formed at a lesser cost. Where the concrete is used in roadways or the like, the presence of the fibers at the exposed surface of the roadway also provides improved wear resistance.

One perplexing difficulty that has stymied extensive use of fiber reinforced concrete is the tendency of the fibers to adhere to each other and form balls which are not fully wetted by the concrete mix itself resulting in a poor bond and decreased strength as a result. Where the balls of fiber are of significant size, a partial void will result in the concrete with a resultant flaw or weak spot.

SUMMARY OF THE INVENTION

It is the principal object of the invention to provide a new and improved fibrous concrete forming system. More specifically, it is an object of the invention to provide such a system wherein fibrous reinforcing material is added to other solid concrete ingredients as substantially individual fibers and wherein the addition of balls of fiber to the ingredients is precluded.

The exemplary embodiment of the invention achieves the foregoing object in a system including a conveyor for introducing concrete ingredients in solid form into a mixer or the like. A first apportioning device apportions large aggregate onto the conveying means. A second apportions cement onto the conveying means, while a third apportions sand onto the conveying means. In the improved system, a means is provided for apportioning fibrous reinforcing material onto the conveyor. A means defining a source of fibrous reinforcing material is also provided and feeds fibrous reinforcing material to a separating means which, in turn, separates the fibrous reinforcing material into (a) balls of fiber and (b) substantially individual fibers. A means is associated with the separator for directing only substantially individual fibers to the apportioning device for the fibrous reinforcing material.

According to the preferred embodiment, means are also included and associated with the separator for returning balls of fiber to the source.

According to highly preferred embodiments of the invention, beating devices may be interposed between the source of material and the separator and/or between the separator and the conveyor for breaking up balls of fiber.

According to the best mode of the invention contemplated, the separating means comprises an air classifier defined by a housing having an upper fibrous reinforcing material inlet and a lower fiber ball outlet. The housing also includes a side, individual fiber outlet, and a means for directing air across the interior of the housing towards the side outlet.

Louvers are associated with the side outlet for directing entrained fibers in a predetermined path and an impact surface is positioned in the path to be struck by entrained fibers to break up small groups of fibers passing through the side outlet of the separator.

Other objects and advantages of the invention will become apparent from the following specification taken in connection with the accompanying drawings.

DESCRIPTION OF THE PREFERRED EMBODIMENT

Figure 1:
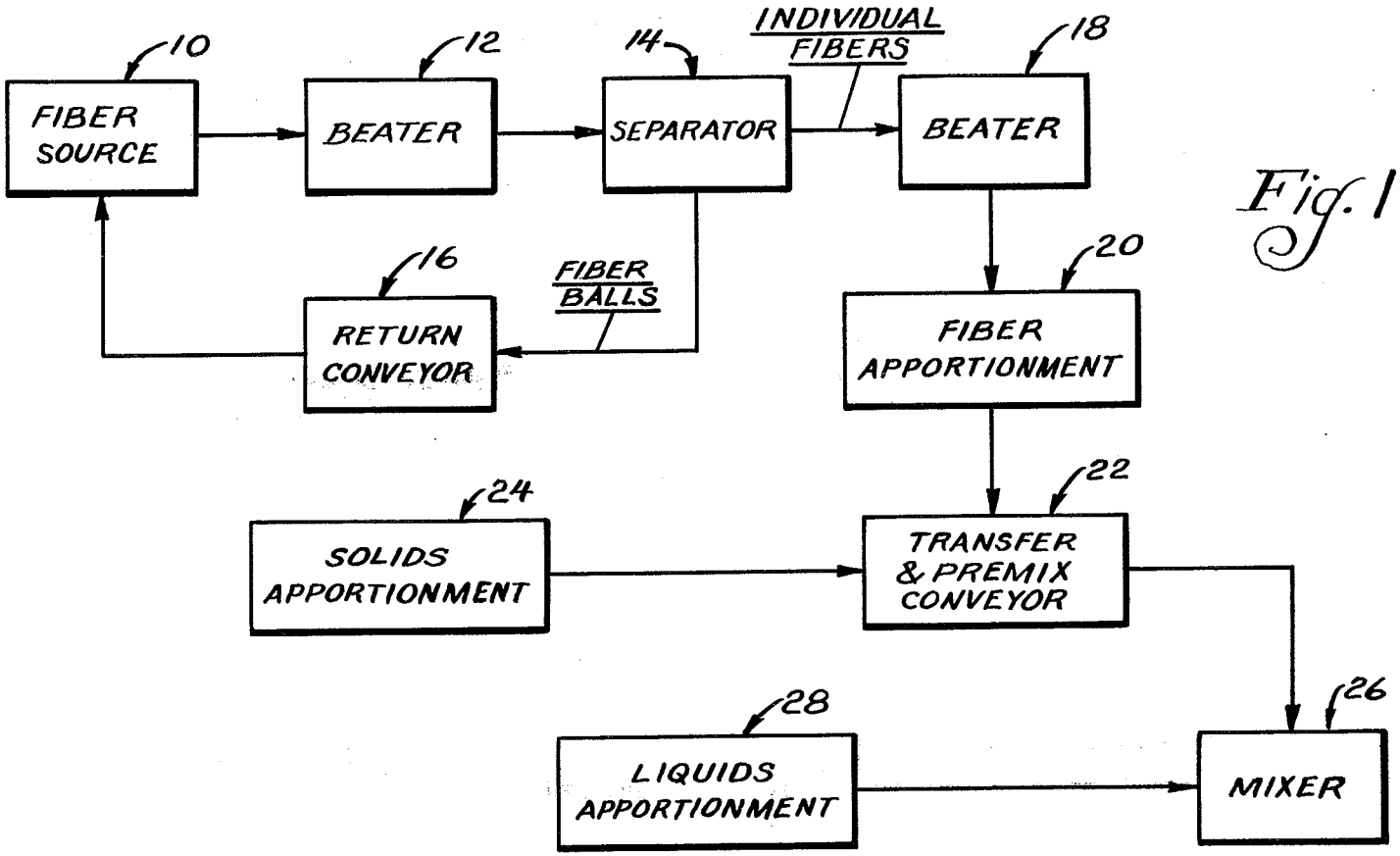
FIG. 1 is a schematic flow diagram of a fibrous concrete batch forming system made according to the invention.

An exemplary embodiment of a fibrous concrete batch forming system made according to the invention is illustrated in FIG. 1 and is seen to include a fiber source, generally designated 10, which may be in the form of a hopper or the like, for receipt of reinforcing fibrous material. Typically, but not always, the fibrous material placed in the source 10 will be steel fiber. Fibrous material from the source 10 is then passed through a break-up device or beater, generally designated 12, to break up clumps or balls of fiber.

From the beater 12, the fibrous material is fed to a separator, generally designated 14, which separates the fiber into two fractions. A first fraction is that of substantially individual fibers, while a second fraction is that of fiber balls which have not been broken up by the beater 12.

A return conveyor, generally designated 16, is associated with the separator 14 for returning the fiber balls to the fiber source to eliminate waste.

The individual fibers from the separator 14 are optionally fed to a further beater, generally designated 18, and then to a fiber apportioning device, generally designated 20. The fiber apportioning device 20, in turn, feeds fibers at a controlled rate to a transfer and premix conveyor, generally designated 22. The conveyor 22 is associated with a plurality of solid apportioning devices, generally designated 24, and performs the function of initially mixing the solid ingredients together with the fiber reinforcing material.

The conveyor 22, while mixing the solid ingredients and the fibers, feeds the same to a conventional mixer 26. A liquid apportioning device, generally designated 28, adds the necessary liquid to the mixer. The final mix of all ingredients is obtained in the mixer 26 and may be dispensed therefrom in a conventional fashion.

Figure 2:
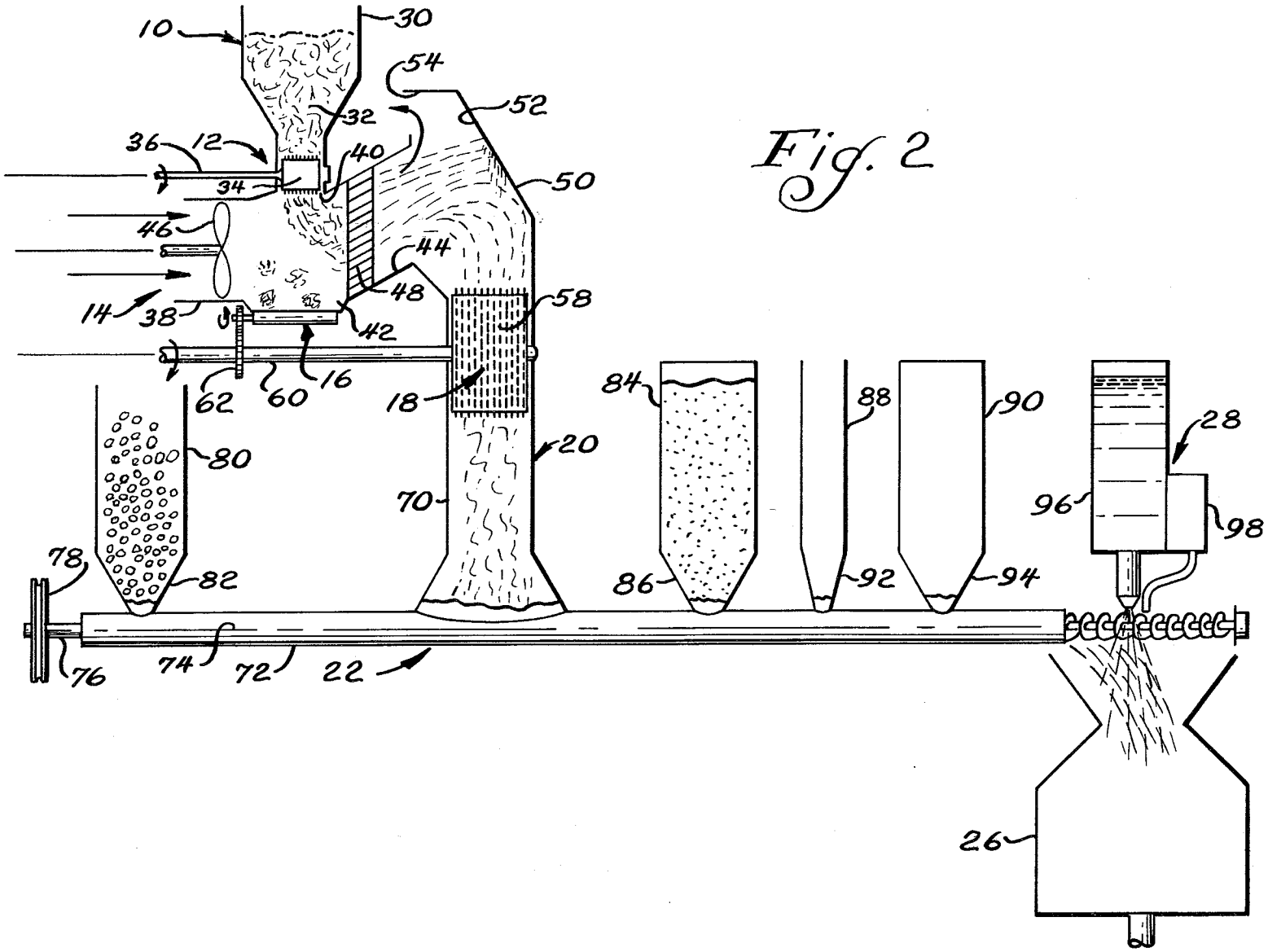
FIG. 2 is a somewhat schematic illustration of a batch forming apparatus made according to the invention.

Turning now to FIG. 2, one form of an apparatus implementing the inventive system is illustrated. In particular, the fiber source 10 is seen to include a hopper 30 having an outlet 32 adjacent its bottom. Disposed within the outlet 32 is the beater 12 which is in the form of a pin mill 34 rotatable on a shaft 36. The pin mill 34 is a conventional drum provided with radially outwardly extending pins which are in close proximity to the sides of the outlet 32 of the hopper 30 and which may further mesh with stationary pins mounted thereon with relatively close tolerances. As a consequence, balls of fiber will not readily pass through the outlet 32.

The separator 14 is defined by a housing 38 having an upper inlet 40 adjacent the pin mill 34 for receipt of fibrous reinforcing material therefrom. The housing 38 includes a lower outlet 42 in which is disposed the return conveyor 16. The housing 38 includes a side outlet 44 and an opposed air inlet in which is located a rotary fan 46 for directing a current of air across the interior of the housing 38 towards the side outlet 44.

As a result, it will be appreciated that air classification of the fibrous reinforcing material will take place within the housing 38. Fibers adhered together in the form of balls will not be appreciably deflected by the airstream and will fall to the conveyor 16 to be returned to the hopper 30. On the other hand, substantially individual fibers will be entrained in the air stream and directed out of the outlet 44.

According to a preferred embodiment of the invention, disposed within the outlet is a louver structure 48 which is operative to direct the airstream and the fibers entrained therein somewhat upwardly in a predetermined path. A further housing 50 is associated with the outlet 44 and includes an impact surface 52 disposed in the predetermined path of air and entrained fibers. Thus, the fibers entrained with the air will impact against the surface 52. As a consequence, the fibers will come out of entrainment in the air current and any small groups of fibers adhered to each other will tend to break up upon the impact against the surface 52.

The housing 50 also includes an upper outlet 54 for air to exit the system.

Disposed below the impacting surface 52 is a further pin mill 58 rotatable with a shaft 60 and defining the beater 18. As illustrated, suitable gearing 62 may be employed to convey the rotary motion of the shaft 60 to the conveyor 16 to drive the same.

Below the pin mill 58, is a chute 70 which may be configured in any suitable form to serve as a fiber apportioning device. The chute 70 opens into the housing 72 of an auger conveyor 74 defining the transfer and pre-mix conveyor 22. The auger conveyor 74 includes a shaft 76 bearing a sheave 78 which may be driven to convey material through the housing 72 to the mixing drum 26.

Upstream of the fibrous material apportioning device 20 and in communication with the interior of the auger conveyor housing 72, is a hopper 80 for receipt of large aggregate and terminating in a large aggregate apportioning device 82 which may be of conventional construction.

Downstream of the chute 70 is a hopper 84 for receipt of cement and a cement apportioning device 86 communicating with the interior of the housing 72. Similar hoppers 88 and 90 associated with similar apportioning devices 92 and 94 are employed for apportioning any conventional solid admixture to be used and sand respectively onto the conveyor 74.

In this respect, it is to be understood that the specific forms of the apportioning devices 82, 86, 92 and 94 form no part of the instant invention and may be conventional.

The system is completed by liquid apportionment devices including a device 96 for apportioning water and a device 98 for apportioning a conventional liquid admixture, if used.

From the foregoing, it will be appreciated that a system made according to the invention allows simple addition of fibrous reinforcing material to concrete in such a way that the addition of balls is avoided. Moreover, the formation of balls in the mixture is similarly avoided through the use of the various apportioning devices. As a consequence, through the use of the system, the difficulties caused by balling of fibers in fiber reinforced concrete are avoided thereby enabling its extensive use to obtain, reliably, the well known desirable qualities thereof.

I claim:

1. In a concrete batch forming system including conveying means for introducing concrete ingredients in solid form into a mixer or the like, means for apportioning large aggregate onto said conveying means, means for apportioning cement onto said conveying means, means for apportioning sand onto said conveying means, means for apportioning fibrous reinforcing material onto said conveying means, the improvement comprising, means for providing a source of fibrous reinforcing material, means for separating fibrous reinforcing material from said source into (a) balls of fiber and (b) substantially individual fibers; means for directing only substantially individual fibers from said separating means to said fibrous reinforcing material apportioning means, said separating means comprising an air classifier including a housing having an upper, fibrous reinforcing material inlet, a lower fiber ball outlet, a side individual fiber outlet, and means for directing air across the interior of said housing toward said side outlet; and louvers associated with said side outlet for directing entrained fibers in a predetermined path, and means downstream of said louvers defining an impact surface positioned in said path to be struck by entrained fibers to break up small groups of fibers passing through said side outlet.

* * * * *